US008109476B2

(12) United States Patent
Roberts et al.

(10) Patent No.: US 8,109,476 B2
(45) Date of Patent: Feb. 7, 2012

(54) BAGGIE HOLDER

(75) Inventors: Stacey Roberts, Sheridan, WY (US); Don Roberts, Sheridan, WY (US); Ian Kovacevich, Charlotte, NC (US); Jason Huneycutt, Charlotte, NC (US); Daniel Bizzell, Charlotte, NC (US)

(73) Assignee: Baggie Helper, LLC, Sheridan, WY (US)

( * ) Notice: Subject to any disclaimer, the term of this patent is extended or adjusted under 35 U.S.C. 154(b) by 75 days.

(21) Appl. No.: 12/824,178

(22) Filed: Jun. 26, 2010

(65) Prior Publication Data

US 2011/0315831 A1 Dec. 29, 2011

(51) Int. Cl.
*A63B 55/04* (2006.01)

(52) U.S. Cl. ..... 248/97; 248/95; 248/99; 248/100; 248/166; 248/170; 248/173; 248/346.3

(58) Field of Classification Search ..... 248/346.3, 248/346.5, 346.03, 149, 150, 146, 173, 170, 248/166, 100, 99, 95, 97
See application file for complete search history.

(56) References Cited

U.S. PATENT DOCUMENTS

| | | | | |
|---|---|---|---|---|
| 1,971,642 | A | 8/1934 | Champlin | |
| 2,030,775 | A | 2/1936 | Twiss | |
| 2,048,608 | A * | 7/1936 | Holland | 248/150 |
| 2,470,977 | A | 5/1949 | Chidsey | |
| 3,913,810 | A | 10/1975 | Shaw | |
| 3,923,318 | A * | 12/1975 | Renard et al. | 280/35 |
| 4,267,996 | A | 5/1981 | Turcott | |
| 4,413,800 | A | 11/1983 | Kelson | |
| 4,638,968 | A | 1/1987 | Auten | |
| 5,172,457 | A * | 12/1992 | Allen et al. | 27/1 |
| D334,854 | S | 4/1993 | Pestone | |
| 5,881,975 | A * | 3/1999 | Bianco | 248/95 |
| D423,823 | S | 5/2000 | Nelson | |
| 6,419,198 | B1 * | 7/2002 | Einav | 248/346.07 |
| 6,505,745 | B1 | 1/2003 | Anderson | |

* cited by examiner

*Primary Examiner* — Amy J Sterling
(74) *Attorney, Agent, or Firm* — Antionette M. Tease

(57) ABSTRACT

A baggie holder comprising first and second support members, the center portions of which are pivotally connected to each other. Each of the first and second support members comprises two legs, and each leg comprises a roughly vertical member, a foot, and a connecting portion between the foot and the center portion of the support member. The length of each connecting portion of each of the four legs is the same.

6 Claims, 5 Drawing Sheets

BAGGIE HOLDER

BACKGROUND OF THE INVENTION

1. Field of the Invention

The present invention relates generally to the field of kitchen implements, and more specifically, to a collapsible device that holds a baggie open so that it can be filled.

2. Description of the Related Art

Nearly everyone who has attempted to fill a baggie with anything while alone in the kitchen has struggled with the problem of how to hold the baggie open while filling it. These incidents often result in stuff being spilled because a person is not able to hold the baggie open while filling it at the same time. In fact, it is virtually impossible to fill a baggie with a liquid unless someone else is holding the baggie open for you.

What is needed is a device that can be used to hold a baggie open while it is filled and that can be easily used by a person working alone in the kitchen. Ideally, the device would be collapsible so that it does not take up much room in a kitchen drawer or cabinet.

U.S. Pat. No. 4,267,996 (Turcott, 1981) discloses a foldable device for holding a leaf bag open. The device is comprised of two pairs of legs, each pair being connected to a base member. The legs protrude outwardly at an angle from each base member, and the base members are pivotally connected to each other so that the device may be folded for storage. The legs are comprised of a resilient material so that they can be bowed inward to place the bag over them and so that they will hold the bag taught when released. The legs are inserted into leg holes in the base members and secured in place with thumb screws. One base member is shorter than the other so that one pair of legs is situated inside of the other pair of legs when the device is folded.

U.S. Pat. No. 1,971,642 (Champlin, 1934) describes a paper bag holder with two U-shaped bag supports, each comprised of parallel side bars joined by a straight connecting bar. Each of the U-shaped bag supports is formed from a single strip of resilient sheet metal, and one of the U-shaped bag supports is wider than the other. One of the U-shaped support bags comprises two pairs of feet (an inner pair and an outer pair), and the other U-shaped support bag comprises a single pair of feet. The U-shaped bag supports are pivotally connected to each other at the center of each connecting bar, and the narrower bag support may be swung so that its feet nest within the inner-most pair of feet of the wider bag support.

U.S. Pat. No. 2,030,775 (Twiss, 1936) provides a container holder in which two base pieces are pivotally connected for a swinging movement. A pair of L-shaped arms is attached to each base piece so that the arms extend vertically upward from the ends of the base pieces. When the device is in a collapsed position, one pair of the L-shaped arms rests within the other; although the length of each base piece is adjustable via a series of slots and rivets, the length of one of the base pieces must be shorter than the length of the other base piece in order for the device to fully collapse.

U.S. Pat. No. 4,413,800 discloses a trash bag caddy comprising a circular ring or hoop at the top. The circular ring or hoop is attached to two U-shaped leg members, each of which has a central section. The central section of one leg member crosses over the central section of the other leg member and is fixed at a right angle to the central section of the other leg member via a retaining socket. The device is not collapsible.

U.S. Pat. No. D423,823 (Nelson, 2000) shows an apparatus for holding a plastic bag. The apparatus is non-collapsible and has a rigid base.

The present invention is superior to all of the devices discussed above because it is specifically adapted for use with a baggie (as opposed to a larger bag like a leaf bag or a trash bag), and it collapses in a manner that is distinct from any of the inventions described above. As described more fully below, due to the manner in which the device collapses, it is able to hold the baggie in a perfectly even configuration because the distance between one pair of leg members is equal to the distance between the other pair of leg members. In other words, when the device collapses, the two pairs of leg members are perfectly aligned.

BRIEF SUMMARY OF THE INVENTION

The present invention is a baggie holder comprising: a first support member having a first leg, a second leg, and a center portion with a center point; and a second support member having a first leg, a second leg, and a center portion with a center point; wherein the center portions of the first and second support members are pivotally connected to each other; wherein each leg of the first and second support members comprises a roughly vertical member, a foot, and a connecting portion between the foot and the center portion of the support member; wherein the horizontal distance between the center point of the center portion of the first support member and the foot of the first leg of the first support member is equal to the horizontal distance between the center point of the center portion of the first support member and the foot of the second leg of the first support member; wherein the horizontal distance between the center point of the center portion of the second support member and the foot of the first leg of the second support member is equal to the horizontal distance between the center point of the center portion of the second support member and the foot of the second leg of the second support member; and wherein the horizontal distance between the center portion of the first support member and the foot of each leg of the first support member is equal to the horizontal distance between the center portion of the second support member and the foot of each leg of the second support member.

In a preferred embodiment, each leg of the first and second support members comprises a distal end terminating in a hook. Preferably, the horizontal distance between the center point of the center portion of the first support member and the hook on the distal end of the first leg of the first support member is equal to the horizontal distance between the center point of the center portion of the first support member and the hook on the distal end of the second leg of the first support member; the horizontal distance between the center point of the center portion of the second support member and the hook on the distal end of the first leg of the second support member is equal to the horizontal distance between the center point of the center portion of the second support member and the hook on the distal end of the second leg of the second support member; and the horizontal distance between the center portion of the first support member and the hook on the distal end of each leg of the first support member is equal to the horizontal distance between the center portion of the second support member and the hook on the distal end of each leg of the second support member.

In a preferred embodiment, the connecting portions of each leg of the first and second support members are equal in length. Preferably, when the center portion of the first support member rotates ninety degrees on the center portion of the second support member, the first leg of the first support member is completely horizontally aligned with the first leg of the second support member and the second leg of the first support member is completely horizontally aligned with the second leg of the second support member such that no one leg is further from the center portions than any other leg.

In a preferred embodiment, the center portions lock in place relative to one another when the first and second legs of the first support member are at ninety-degree angles to the first and second legs of the second support member and the baggie holder is in a fully extended position. Preferably, the center portions lock in place relative to one another when the first leg of the first support member is parallel to the first leg of the second support member and the second leg of the first support member is parallel to the second leg of the second support member and the baggie holder is in a fully collapsed position.

REFERENCE NUMBERS

1 First support member
1A First leg (of first support member)
1B Second leg (of first support member)
1B Second support member
2A First leg (of second support member)
2B Second leg (of second support member)
3 Roughly vertical member (of leg)
4 Hook (of leg)
5 Foot (of leg)
6 Connecting portion
7 Shaft
8 Screw
9 Washer
10 Spring
11 Aperture (for shaft)
12 Ceiling (of center portion 2C)
13 Lip (of center portion 2C)
14 Outer wall (of center portion 2C
15 Notches/indentations (in lip of center portion 2C)
16 Collar (of center portion 2C)
17 Shaft housing
18 Outer wall (of center portion 1C)
19 Ridge (of center portion 1C)
20 Protrusions (on ridge of center portion 1C)
21 Baggie

DETAILED DESCRIPTION OF INVENTION

Figure 1:
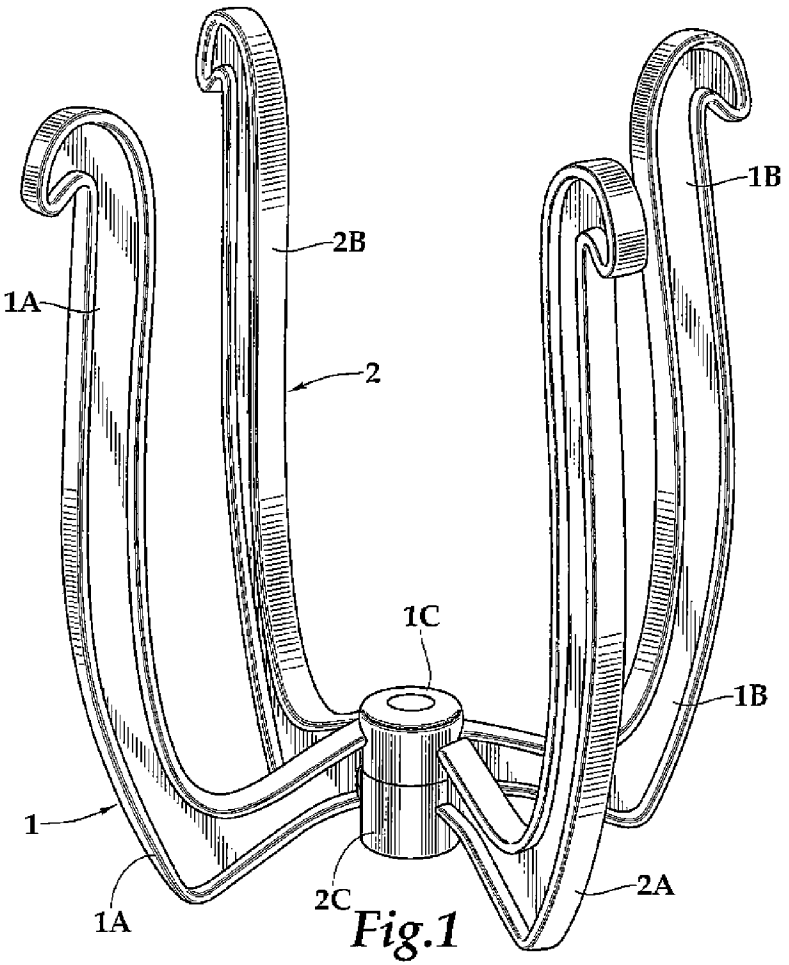
FIG. 1 is a perspective view of the present invention in a fully extended position.

FIG. 1 is a perspective view of the present invention in a fully extended position. As shown in this figure, the present invention comprises a first support member 1 and a second support member 2. The first support member 1 comprises a first leg 1A, a second leg 1B, and a center portion 1C. The second support member 2 comprises a first leg 2A, a second leg 2B, and a center portion 2C. The center portions 1C, 2C are pivotally connected to one another, as shown in subsequent figures.

Figure 2:
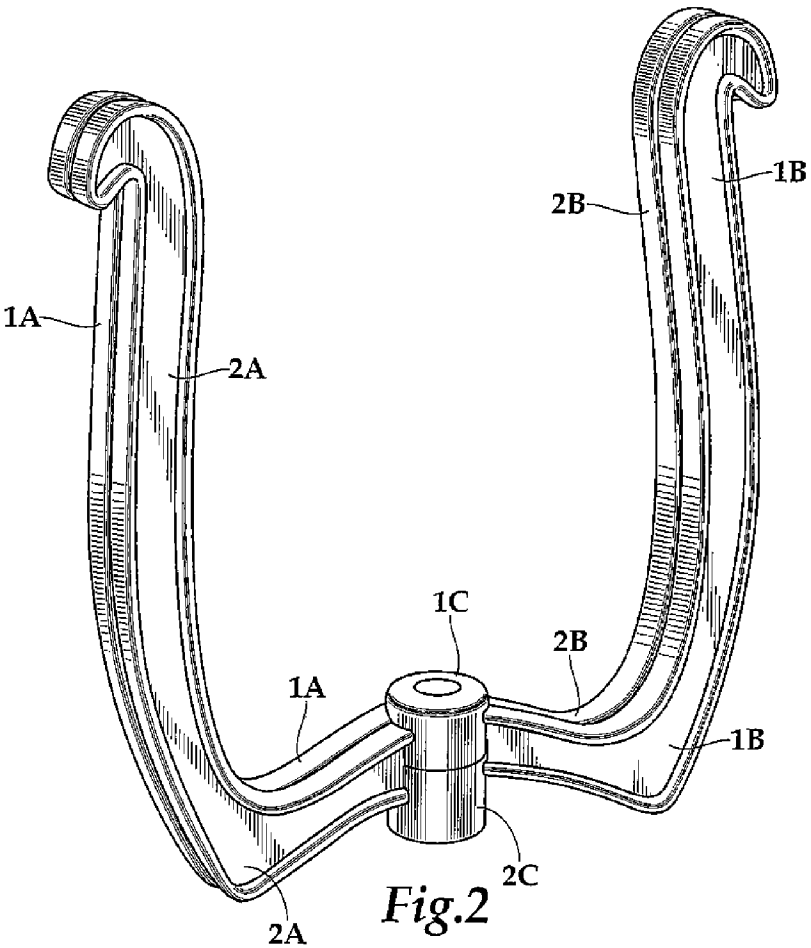
FIG. 2 is a perspective view of the present invention in a fully collapsed position.

FIG. 2 is a perspective view of the present invention in a fully collapsed position. In this figure, center portion 2C has been rotated approximately ninety (90) degrees to the left (clockwise) such that first leg 2A is now directly adjacent (side-by-side) and completely parallel to (in this figure, in front of) first leg 1A. Similarly, second leg 2B is now directly adjacent (side-by-side) and completely parallel to (in this figure, behind) second leg 1B. The device is easily stored in a collapsed position.

Figures 7, 8, 9:
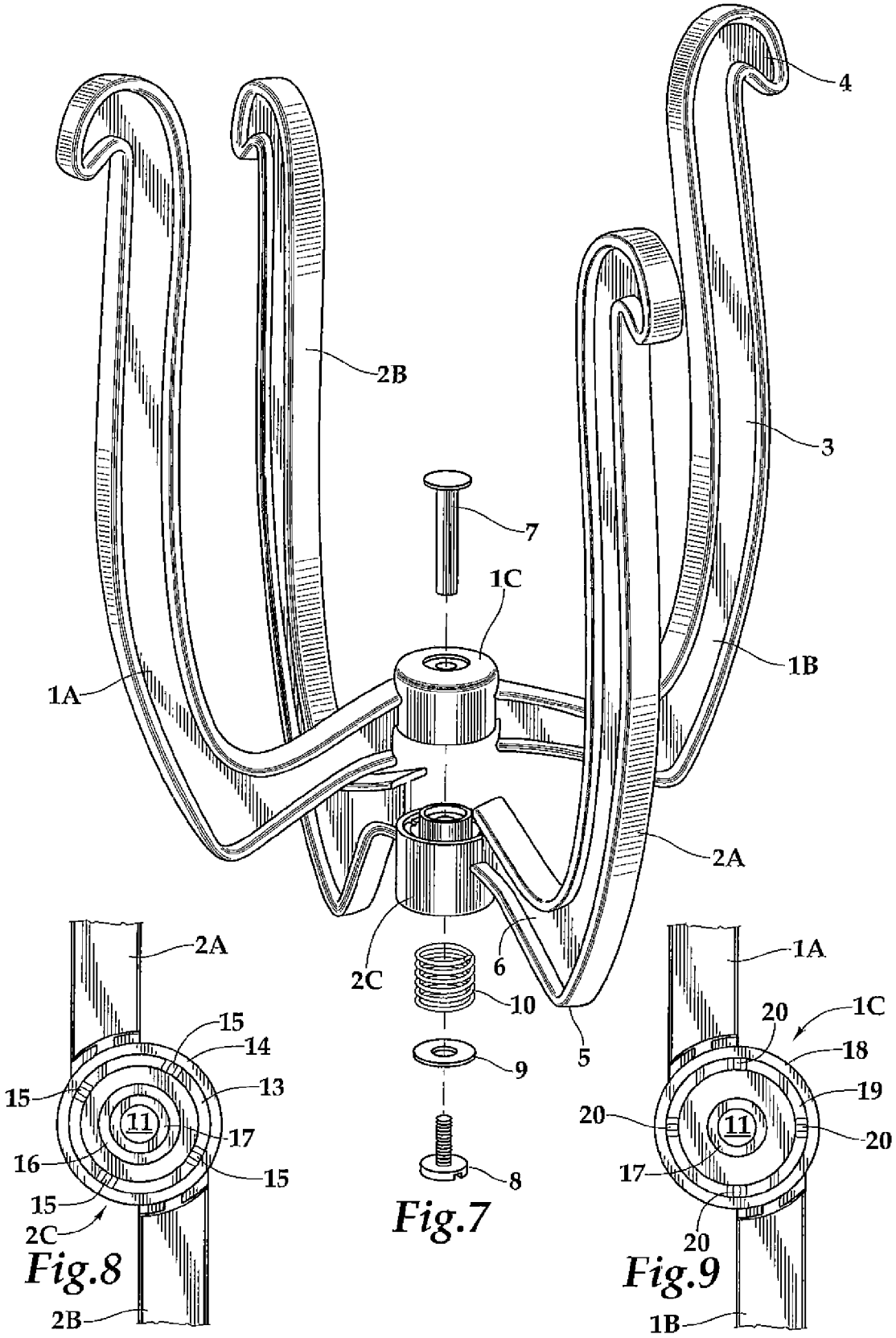
FIG. 7 is an exploded view of the present invention.
FIG. 8 is a top view of the center portion 2C.
FIG. 9 is a bottom view of the center portion 1C.

Each of the first leg 1A, second leg 113, first leg 2A and second leg 2B comprises a roughly vertical member 3, a distal end terminating in a hook 4, a foot 5, and a connecting portion 6 between the foot 5 and the center portion 1C, 2C (see FIG. 7). The horizontal distance between the center point of the center portion 2C (and 1C, not shown) and the tip of the foot 5 is equal on all four legs (this distance is shown as "X" in FIG. 5). Unlike the prior art, this configuration provides greater stability to the device when it is in use.

Figure 3:
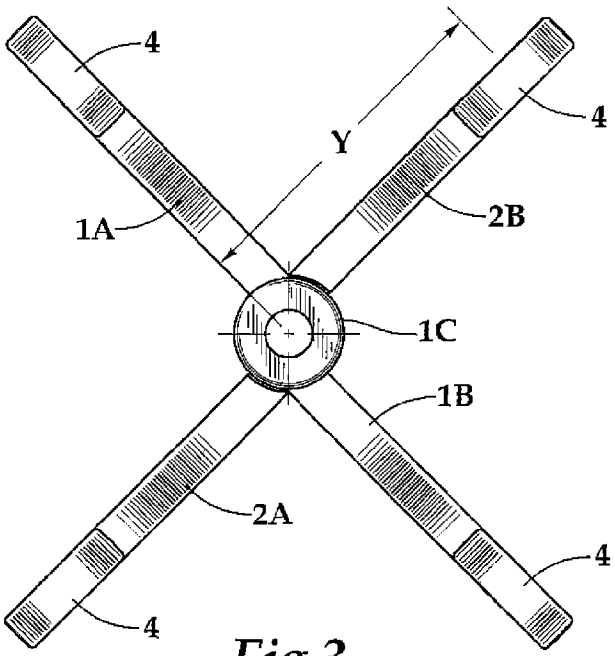
FIG. 3 is a top view of the present invention in a fully extended position.
Figure 4:
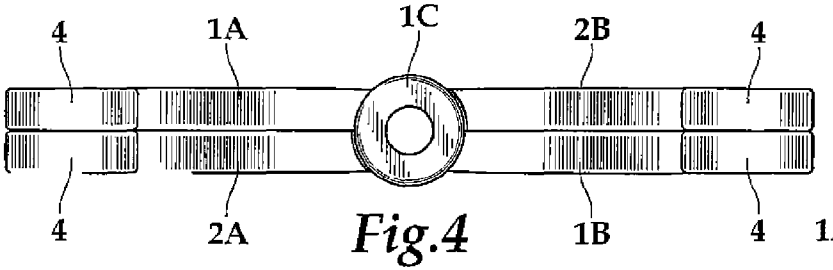
FIG. 4 is a bottom view of the present invention in a fully extended position.

FIG. 3 is a top view of the present invention in a fully extended position. This figure shows that the horizontal distance between the center point of the center portion 1C (and 2C, not shown) and the center point of each hook 4 is equal on all four legs (this distance is shown as "Y" in FIG. 3). Unlike the prior art, this configuration allows for a more even distribution of contents within the baggie (see FIG. 10) because the width by which the baggie is opened is roughly the same as the depth by which the baggie is opened (i.e., the distance between legs 1A and 1B is equal to the distance between legs 2A and 2B). FIG. 4 is a bottom view of the present invention in a fully extended position.

Figure 5:
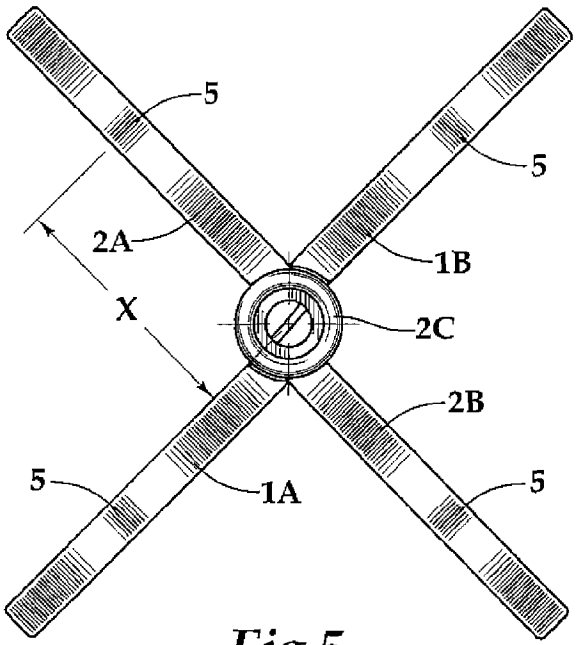
FIG. 5 is a top view of the present invention in a fully collapsed position.
Figure 6:
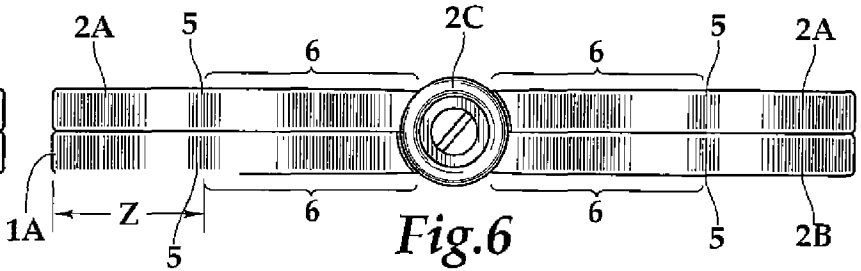
FIG. 6 is a bottom view of the present invention in a fully collapsed position.

FIGS. 5 and 6 are top and bottom views, respectively, of the device in a fully collapsed position. As shown in these figures, legs 1A and 2A and legs 1B and 2B are completely horizontally aligned (i.e., parallel to one another). In other words, the connecting portions 6 of each leg are the same length, as is the distance between the tip of the foot 5 and the outer-most edge of the leg (this distance is shown as "Z" in FIG. 5).

FIG. 7 is an exploded view of the present invention. As shown in this Figure, the two center portions 1C, 2C are connected by a shaft 7 that extends from the top of the center portion 1C through center portion 2C. The shaft 7 is preferably threaded inside of the shaft, and a screw 8 is inserted (screwed) into the shaft 7 to secure it in place. A washer 9 is preferably situated between the screw 8 and a spring 10. The spring 10 is situated inside of the center portion 2C between the ceiling 12 of the center portion 2C and the washer 9. The spring 10 serves to impose an upward bias on the center portion 2C so that it will "lock" in place in either an open (fully extended) or closed (fully collapsed) position, as explained more fully below in connection with FIGS. 8 and 9.

FIG. 8 is a top view of the center portion 2C. This figure shows the aperture 11 through which the shaft 7 (not shown) is inserted. A lip 13 (lower than the outer wall 14) lies just inside of the outer wall 14 of the center portion 2C, and there are notches or indentations 15 in the lip 13, the purpose of which will become clear in connection with FIG. 9 below. This figure also shows the collar 16 surrounding the shaft housing 17.

FIG. 9 is a bottom view of the center portion 1C. This figure shows the aperture 11 through which the shaft 7 (not shown)

is inserted. Just inside the outer wall 18 of the center portion 1C is a ridge 19 (extending outward from the outer wall 18) with protrusions 20. These protrusions 20 rest inside of the notches or indentations 15 in the lip 13 of the center portion 2C when the device is in an open (fully extended) or closed (fully collapsed) position. The spring 10 applies mechanical force to hold the protrusions 20 inside the notches or indentations 15 such that an opposite mechanical force (as in a person rotating the center portion 1C on center portion 2C must be applied to overcome the mechanical force of the spring 10. In this manner, a person using the device need not worry that it will collapse while in use, nor will it open when placed in a drawer in a collapsed position for storage purposes.

FIG. 9 also shows the shaft housing 17. When the device is fully assembled, the collar 16 encircles the shaft housing 17 of the center portion 1C. This ensures that the two center portions 1C, 2C are centrally aligned.

Figure 10:
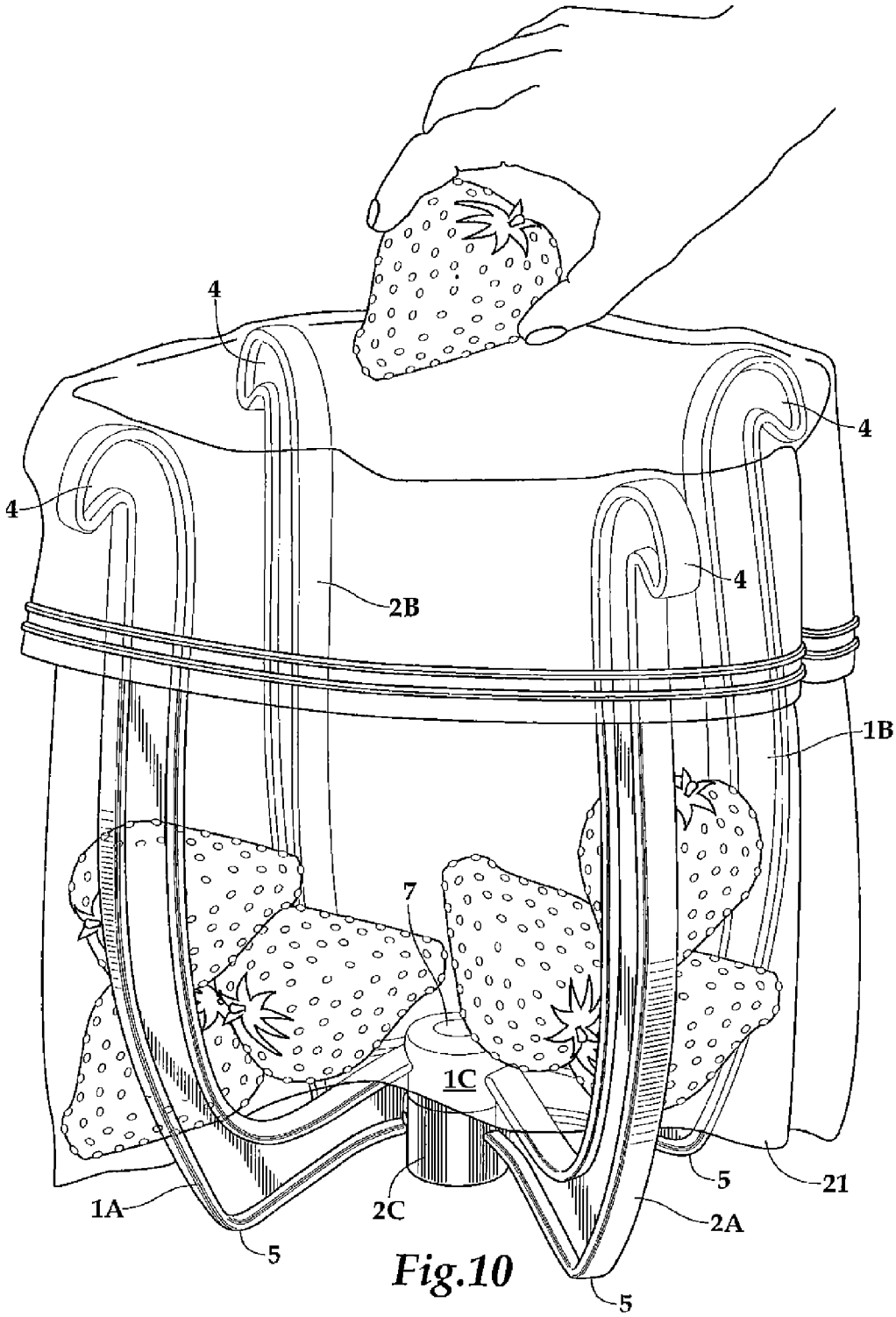
FIG. 10 is a perspective view of the present invention with a baggie inserted over the top of the device.

FIG. 10 is a perspective view of the present invention with a baggie 21 inserted over the top of the device. As shown in this figure, when the device is in an open (fully extended) position, it forms a well into which the bottom of the baggie 21 is placed. The top of the baggie is folded over the hooks 4 on the distal ends of the legs 1A, 1B, 2A, 2B to hold the baggie open. With the baggie in this position, food or other objects are easily placed or poured into the baggie without spillage.

Figure 11:
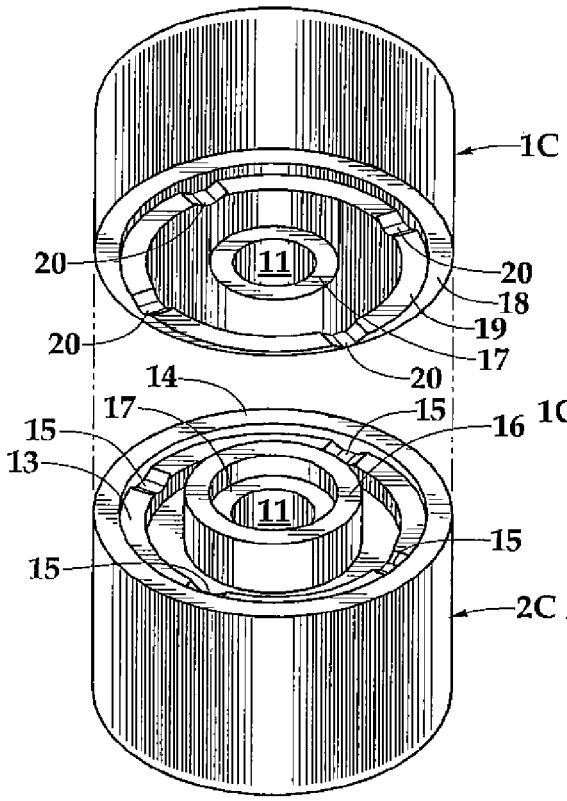
FIG. 11 is a detail perspective view of the underside of the center portion 1C and the top side of the center portion 2C.
Figure 12:
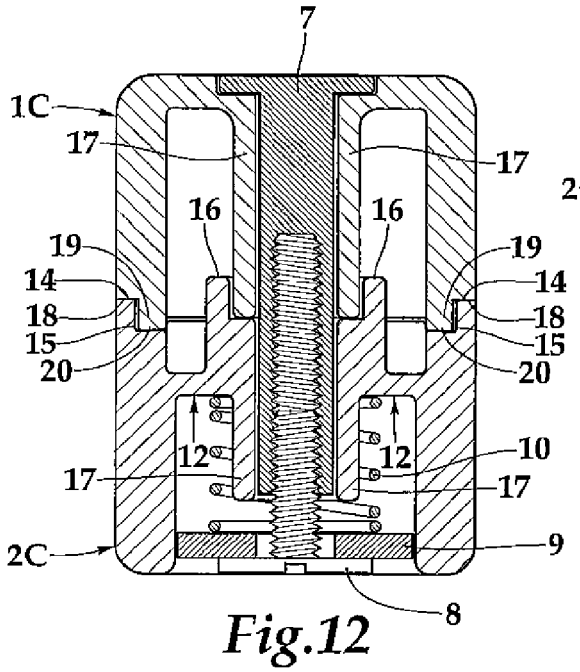
FIG. 12 is a section view of the center portions 1C, 2C.
Figure 13:
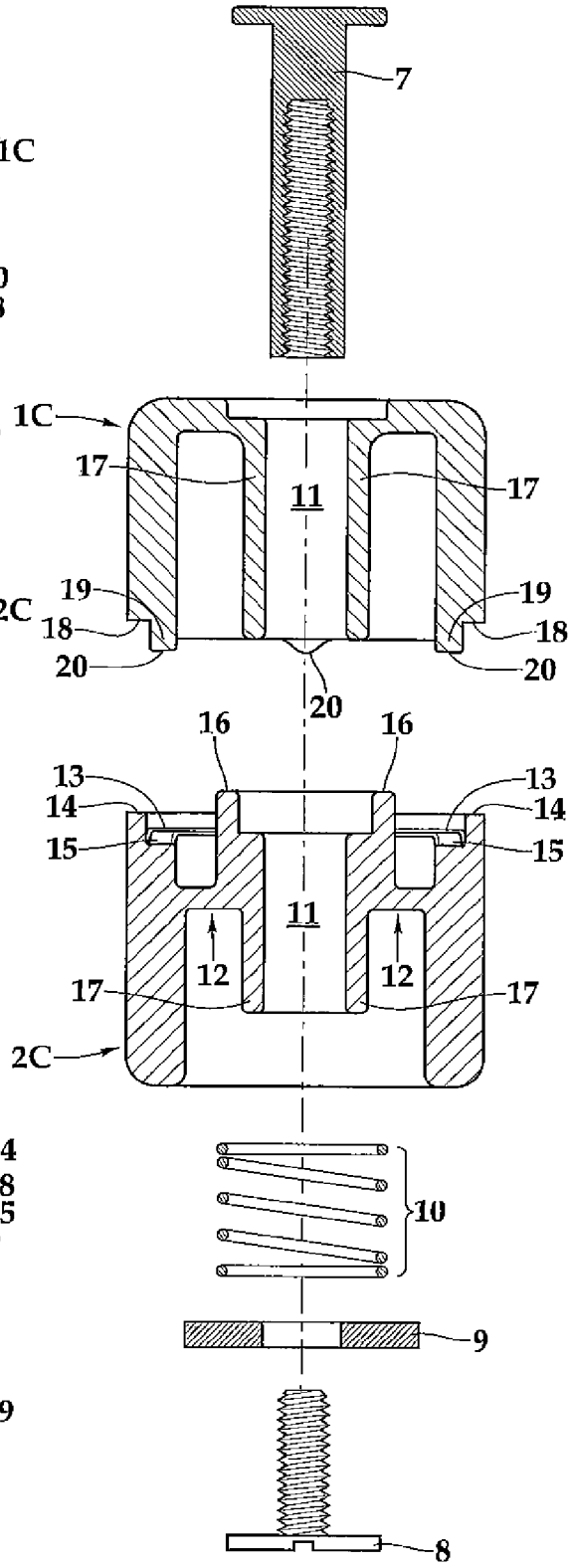
FIG. 13 is an exploded section view of the center portions 1C, 2C.

FIG. 11 is a detail perspective view of the underside of the center portion 1C and the top side of the center portion 2C. The legs 1A, 1B, 2A, 2B have been omitted for clarity. FIGS. 12 and 13 are a section view and an exploded section view, respectively, of the center portions 1C, 2C.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A baggie holder comprising:

a first support member having a first leg, a second leg, and a first center portion with a center point and a top;

a second support member having a first leg, a second leg, and a second center portion with a center point and a ceiling;

a shaft that extends from the top of the first center portion through the second center portion; and a spring that is situated inside of the second center portion around the shaft and that imposes an upward bias on the second center portion;

wherein the center portions of the first and second support members are pivotally connected to each other;

wherein each leg of the first and second support members comprises a roughly vertical member, a foot, and a connecting portion between the foot and the center portion of the support member;

wherein the horizontal distance between the center point of the center portion of the first support member and the foot of the first leg of the first support member is equal to the horizontal distance between the center point of the center portion of the first support member and the foot of the second leg of the first support member;

wherein the horizontal distance between the center point of the center portion of the second support member and the foot of the first leg of the second support member is equal to the horizontal distance between the center point of the center portion of the second support member and the foot of the second leg of the second support member;

wherein the horizontal distance between the center portion of the first support member and the foot of each leg of the first support member is equal to the horizontal distance between the center portion of the second support member and the foot of each leg of the second support member;

wherein the spring causes the center portions to lock in place relative to one another when the first and second legs of the first support member are at ninety-degree angles to the first and second legs of the second support member and the baggie holder is in a fully extended position; and wherein the spring causes the center portions to lock in place relative to one another when the first leg of the first support member is parallel to the first leg of the second support member and the second leg of the first support member is parallel to the second leg of the second support member and the baggie holder is in a fully collapsed position.

2. The baggie holder of claim 1, wherein each leg of the first and second support members comprises a distal end terminating in a hook.

3. The baggie holder of claim 1, wherein the horizontal distance between the center point of the center portion of the first support member and the hook on the distal end of the first leg of the first support member is equal to the horizontal distance between the center point of the center portion of the first support member and the hook on the distal end of the second leg of the first support member;

wherein the horizontal distance between the center point of the center portion of the second support member and the hook on the distal end of the first leg of the second support member is equal to the horizontal distance between the center point of the center portion of the second support member and the hook on the distal end of the second leg of the second support member; and wherein the horizontal distance between the center portion of the first support member and the hook on the distal end of each leg of the first support member is equal to the horizontal distance between the center portion of the second support member and the hook on the distal end of each leg of the second support member.

4. The baggie holder of claim 1, wherein the connecting portions of each leg of the first and second support members are equal in length.

5. The baggie holder of claim 1, wherein when the center portion of the first support member rotates ninety degrees on the center portion of the second support member, the first leg of the first support member is completely horizontally aligned with the first leg of the second support member and the second leg of the first support member is completely horizontally aligned with the second leg of the second support member such that no one leg is further from the center portions than any other leg.

6. The baggie holder of claim 1, wherein a portion of the connecting portion of the first support member surrounds the center portion of the second support member, and a portion of the connecting portion of the second support member surrounds the center portion of the first support member, such that the portion of the connecting portion of the first support member that surrounds the center portion of the second support member rotates around the center portion of the second support member, and the portion of the connecting portion of the second support member that surrounds the center portion of the first support member rotates around the center portion of the first support member.

* * * * *

UNITED STATES PATENT AND TRADEMARK OFFICE

CERTIFICATE OF CORRECTION

PATENT NO. : 8,109,476 B2
APPLICATION NO. : 12/824178
DATED : February 7, 2012
INVENTOR(S) : Stacey Roberts et al.

It is certified that error appears in the above-identified patent and that said Letters Patent is hereby corrected as shown below:

Title page, item [74], the name of the Attorney, Agent, or Firm appears as Antionette M. Tease. The correct spelling of the Attorney's first name is Antoinette.

Signed and Sealed this
Twenty-seventh Day of November, 2012

David J. Kappos

David J. Kappos
*Director of the United States Patent and Trademark Office*